US010100820B2

(12) United States Patent
Takahashi

(10) Patent No.: US 10,100,820 B2
(45) Date of Patent: Oct. 16, 2018

(54) CRYOPUMP AND VACUUM PUMPING METHOD

(71) Applicant: Sumitomo Heavy Industries, Ltd, Tokyo (JP)

(72) Inventor: Kakeru Takahashi, Tokyo (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 437 days.

(21) Appl. No.: 14/287,755

(22) Filed: May 27, 2014

(65) Prior Publication Data

US 2014/0345300 A1 Nov. 27, 2014

(30) Foreign Application Priority Data

May 27, 2013 (JP) ..... 2013-111346

(51) Int. Cl.
*F04B 37/08* (2006.01)

(52) U.S. Cl.
CPC ..... *F04B 37/08* (2013.01); *F04B 37/085* (2013.01)

(58) Field of Classification Search
CPC ..... F04B 37/02; F04B 37/085; F04B 37/08
See application file for complete search history.

(56) References Cited

U.S. PATENT DOCUMENTS

| | | | | | |
|---|---|---|---|---|---|
| 4,466,252 | A * | 8/1984 | Hood | F04B 37/08 | 417/901 |
| 4,718,241 | A * | 1/1988 | Lessard | F04B 37/08 | 417/901 |
| 5,855,118 | A * | 1/1999 | Lorimer | F04B 37/02 | 417/901 |
| 6,155,059 | A * | 12/2000 | Matte | F04B 37/08 | 62/55.5 |
| 2011/0126553 | A1* | 6/2011 | Ball-DiFazio | F04B 37/08 | 62/6 |
| 2011/0225989 | A1* | 9/2011 | Tanaka | B01D 8/00 | 62/55.5 |

FOREIGN PATENT DOCUMENTS

| | | | |
|---|---|---|---|
| CA | 1192756 | A | 9/1985 |
| JP | S59-131779 | A | 7/1984 |
| JP | 2010-084702 | A | 4/2010 |
| JP | 2012-237262 | A | 12/2012 |

* cited by examiner

*Primary Examiner* — Gerald L Sung
(74) *Attorney, Agent, or Firm* — Michael Best & Friedrich LLP

(57) ABSTRACT

A cryopump includes an adsorption cryopanel including a front surface configured to receive incidence of a non-condensable gas and a back surface having an adsorption region of the non-condensable gas, and a reflection cryopanel including a reflection surface of the non-condensable gas facing the back surface. The adsorption cryopanel may have a multitude of through holes penetrating from the front surface to the back surface. The adsorption cryopanel has a passage probability of the non-condensable gas selected from a range of 10% to 70%.

21 Claims, 9 Drawing Sheets

CRYOPUMP AND VACUUM PUMPING METHOD

BACKGROUND OF THE INVENTION

1. Field of the Invention

The present invention relates to a cryopump and a vacuum pumping method.

2. Description of the Related Art

A cryopump is a vacuum pump for pumping gas molecules by trapping them by condensation or adsorption onto a cryopanel cooled to a cryogenic temperature. The cryopump is generally used to achieve clean vacuum environment that is required for a semiconductor circuit manufacturing process and the like. In an application of the cryopump, which is, for example, ion implantation process, the most of the gas to be pumped is a non-condensable gas such as hydrogen. The non-condensable gas can be pumped only by adsorption onto an adsorption region that is cooled to a cryogenic temperature.

SUMMARY OF THE INVENTION

An exemplary object of an aspect of the present invention is to provide a cryopump and a vacuum pumping method for high speed pumping of a non-condensable gas.

According to an aspect of the present invention, a cryopump is provided that includes an adsorption cryopanel including a front surface configured to receive incidence of a non-condensable gas and a back surface having an adsorption region of the non-condensable gas and a reflection cryopanel including a reflection surface of the non-condensable gas facing the back surface, wherein the adsorption cryopanel has a multitude of holes penetrating from the front surface to the back surface.

According to an aspect of the present invention, a cryopump is provided that includes an adsorption cryopanel including a front surface configured to receive incidence of a non-condensable gas and a back surface having an adsorption region of the non-condensable gas and a reflection cryopanel including a reflection surface of the non-condensable gas facing the back surface, wherein the adsorption cryopanel has a passage probability of the non-condensable gas selected from a range of 10% to 70%.

According to an aspect of the present invention, a vacuum pumping method for pumping a non-condensable gas is provided, and the method includes receiving a non-condensable gas through an adsorption cryopanel into a space between the adsorption cryopanel and a cryopanel adjacent to the adsorption cryopanel, the adsorption cryopanel having a passage probability of the non-condensable gas selected from a range of 10% to 70%; reflecting the non-condensable gas using the cryopanel adjacent to the adsorption cryopanel; and adsorbing the reflected non-condensable gas on the adsorption cryopanel.

Optional combinations of the aforementioned constituting elements, and implementations of the invention in the form of methods, apparatuses, and systems, may also be practiced as additional modes of the present invention.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which.

DETAILED DESCRIPTION OF THE INVENTION

Figure 1:
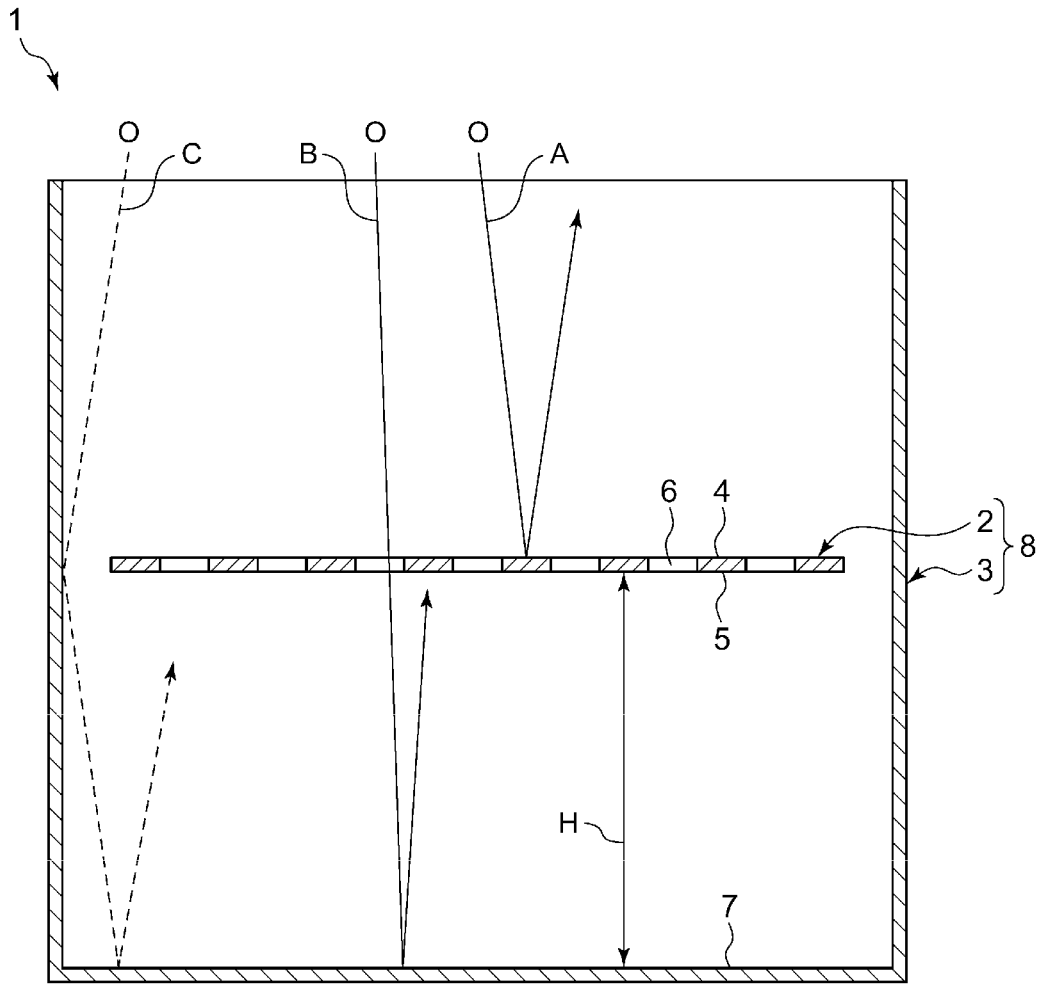
FIG. 1 is a diagram illustrating overview of relevant components of a cryopump according to a first embodiment of the present invention.

The invention will now be described by reference to the preferred embodiments. This does not intend to limit the scope of the present invention, but to exemplify the invention.

Hereinafter, embodiments for carrying out the present invention will be explained in detail with reference to drawings. In the explanation, the same elements are denoted with the same reference numerals, and repeated explanation thereabout is omitted.

FIG. 1 is a diagram illustrating overview of relevant components of a cryopump 1 according to a first embodiment of the present invention. For the sake of brevity, only an adsorption cryopanel 2 and a reflection cryopanel 3 are shown in FIG. 1. FIG. 1 illustrates a cross section including a central axis of the cryopump 1.

The adsorption cryopanel 2 includes a front surface 4 and a back surface 5. The front surface 4 is arranged to receive incidence of non-condensable gas molecules (for example, hydrogen molecules). The back surface 5 includes an adsorption region of a non-condensable gas. The adsorption region is, for example, a region where an adsorbent suitable for adsorbing the non-condensable gas (for example, activated charcoal) is provided.

Figure 2:
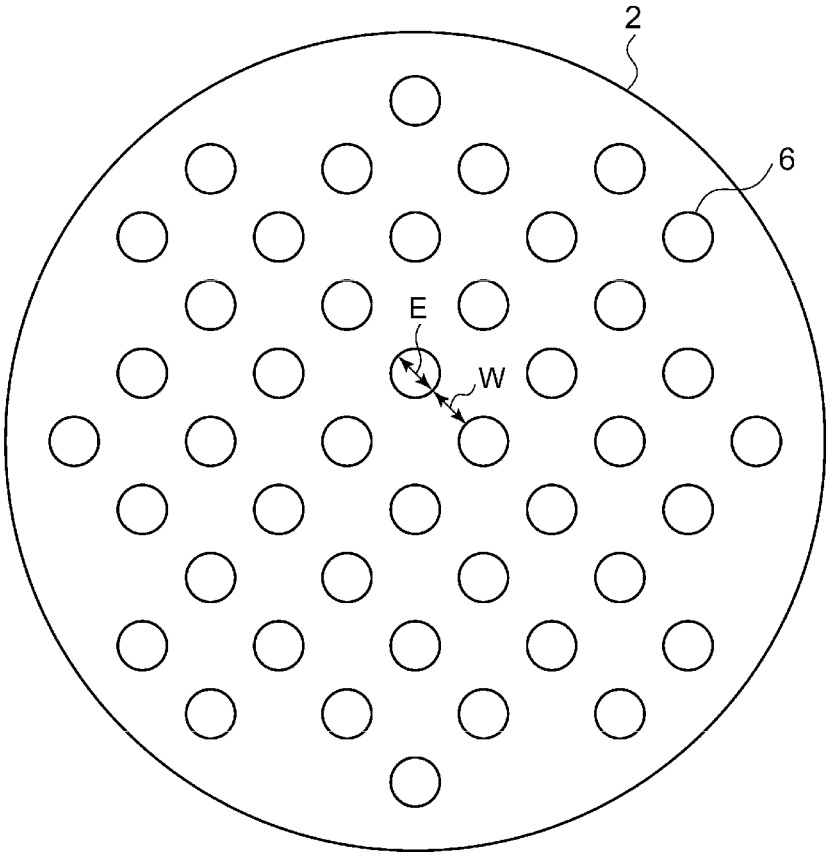
FIG. 2 is a top view illustrating an adsorption cryopanel according to the first embodiment of the present invention.

FIG. 2 is a top view illustrating the adsorption cryopanel 2 according to the first embodiment of the present invention. The adsorption cryopanel 2 includes a multitude of through holes 6. The adsorption cryopanel 2 may be a punching plate or a perforated plate in a circular shape. The through holes 6 are formed to penetrate through the adsorption cryopanel 2 from the front surface 4 to the back surface 5. The through holes 6 shown in the drawing are distributed uniformly over the entire adsorption cryopanel 2. In the adsorption cryopanel 2 as shown in the drawing, the through holes 6 are circular openings arranged in a lattice form.

As shown in FIG. 1, the reflection cryopanel 3 has a reflection surface 7 for non-condensable gas molecules. The reflection surface 7 faces the back surface 5 of the adsorption cryopanel 2. The reflection cryopanel 3 may be a radiation shield for the cryopump 1. In such case, the reflection cryopanel 3 encloses the adsorption cryopanel 2. The front surface 4 of the adsorption cryopanel 2 is oriented to the main opening of the radiation shield, and the back surface 5 of the adsorption cryopanel 2 is oriented to the bottom surface of the radiation shield which is the reflection surface 7.

When the cryopump 1 performs a vacuum pumping operation, the non-condensable gas molecules enter the cryopump 1. For example, as indicated by arrow A, some of the non-condensable gas molecules are reflected by the front surface 4, and returned back to the outside of the cryopump 1.

For example, as indicated by arrow B, some of the non-condensable gas molecules pass through the through holes 6 of the adsorption cryopanel 2, and enter the space between the adsorption cryopanel 2 and the reflection cryopanel 3. The non-condensable gas molecules are reflected by the reflection cryopanel 3. The reflected non-condensable gas molecules are incident upon the back surface 5 of the adsorption cryopanel 2, and are stochastically adsorbed by the adsorption region. Alternatively, the reflected non-condensable gas molecules pass through the through holes 6 again to be returned back to the outside of the cryopump 1.

If the adsorption cryopanel 2 does not have any through hole 6, the path of the non-condensable gas molecules that pass around the adsorption cryopanel 2 is limited to a clearance outside of the adsorption cryopanel 2, for example, as indicated by arrow C of broken line. The non-condensable gas molecules enter from the outside of the adsorption cryopanel 2 and are reflected by the reflection cryopanel 3. Most of them are incident upon the peripheral portion of the back surface 5 of the adsorption cryopanel 2. In this manner, the non-condensable gas molecules are concentrated on the peripheral portion of the adsorption cryopanel 2, which results in a non-uniform two-dimensional distribution of adsorption on the surface of the adsorption cryopanel 2. Accordingly, the adsorption region in the peripheral portion is saturated first, and the cryopump 1 may be required to be regenerated earlier even though the adsorption region in the central portion is still usable.

In order to introduce a large amount of non-condensable gas into the space between the adsorption cryopanel 2 and the reflection cryopanel 3 where no through hole 6 is formed, there is no option but to expand the clearance around the adsorption cryopanel 2. In order to do this, the size of the adsorption cryopanel 2 may be reduced, or the size of the reflection cryopanel 3 (for example, the radiation shield) may be enlarged. A small adsorption cryopanel 2 has a small adsorption region, and therefore, this limits the adsorption performance of the cryopump 1. A large reflection cryopanel 3 makes the size of the cryopump 1 larger, and therefore, this may increase the cost of ownership.

However, according to the present embodiment, the through holes 6 are formed in the adsorption cryopanel 2. This facilitates the non-condensable gas molecules to be incident not only upon the peripheral portion but also upon the central portion of the back surface 5 of the adsorption cryopanel 2. Accordingly, the adsorption region in the central portion of the adsorption cryopanel 2 is also effectively used for pumping the non-condensable gas, and thereby the concentration of adsorption to the external peripheral portion is alleviated.

As described above, the cryopump 1 according to the present embodiment comprises an adsorption cryopanel structure 8 including a pair of cryopanels, which are the adsorption cryopanel 2 and the reflection cryopanel 3 adjacent thereto. At least one of the pair of cryopanels has a certain amount of passage probability of the non-condensable gas, which may be considered as a cryopanel having a kind of transmittance. The adsorption cryopanel structure 8 is configured such that the non-condensable gas is received through such a transmissive cryopanel and captured in the space between the cryopanels. As a result, this alleviates uneven distribution of the amount of adsorption over the cryopanel surface, and the entire adsorption region can be effectively used. Therefore, according to the present embodiment, the pumping speed and/or the accumulation amount of the non-condensable gas can be improved.

According to the present embodiment, the cryopanels can be densely arranged. This helps improve the flexibility in design. This also helps provide the cryopump 1 of which size is small and which has high performance.

By the way, as can be understood from the above explanation, the adsorption cryopanel structure 8 according to the present embodiment is configured such that the passage probability of the non-condensable gas molecules at the adsorption cryopanel 2 has an optimum value or an optimum range. This will be hereinafter explained in detail.

Figure 3:
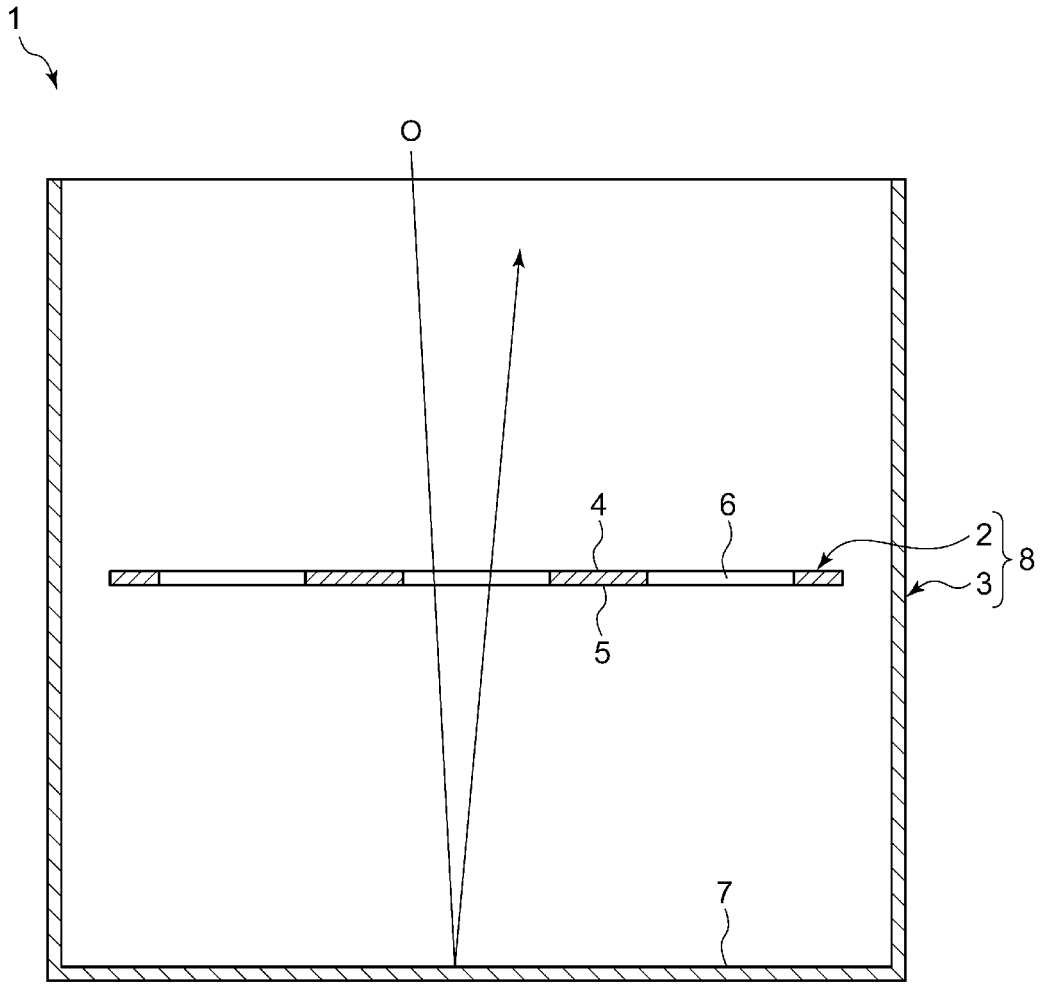
FIG. 3 is a diagram illustrating overview of relevant components of a cryopump according to the first embodiment of the present invention.

Some of the non-condensable gas molecules that have entered the cryopump 1 are returned back to the outside of the cryopump 1 due to the reflection at the reflection cryopanel 3 or the front surface 4 of the adsorption cryopanel 2. When the passage probability at the adsorption cryopanel 2 is excessively high (for example, when the through hole 6 is large as shown in FIG. 3), the reflection at the reflection cryopanel 3 is significant, and this reduces the contribution to the pumping performance of the adsorption cryopanel structure 8. More specifically, as a result of the non-condensable gas molecules passing through the through holes 6 and being reflected by the reflection cryopanel 3, and passing through the through holes 6 again and exiting the cryopump 1, more non-condensable gas molecules are not captured by the adsorption cryopanel structure 8. On the contrary, when the passage probability at the adsorption cryopanel 2 is excessively small, the non-condensable gas molecules are reflected by the front surface 4 of the adsorption cryopanel 2 as in the case where there is no through hole 6, and accordingly, more non-condensable gas molecules are not captured by the adsorption cryopanel structure 8.

The pumping probability of the non-condensable gas according to the adsorption cryopanel structure 8 according to the present embodiment can be derived theoretically using a model as shown in FIG. 1. In the explanation below, the passage probability of the adsorption cryopanel 2 is denoted as t, and the capturing probability of the non-condensable gas at the adsorption region (for example, the adsorption probability of hydrogen by the activated charcoal) is denoted as a.

When N molecules are incident upon the cryopump 1, tN molecules pass through the adsorption cryopanel 2, and (1−t)N molecules are reflected by the front surface 4 of the adsorption cryopanel 2. The tN molecules having passed through the adsorption cryopanel 2 are reflected by the reflection cryopanel 3 and move toward the adsorption cryopanel 2 again. The $t^2N$ molecules pass through the adsorption cryopanel 2, and the t(1−t)N molecules are incident upon the back surface 5 of the adsorption cryopanel 2. Therefore, at(1−t)N molecules are captured by the adsorption region. The molecules which are not captured are reflected by the back surface 5 and move toward the reflection cryopanel 3 again. Such reflection and capturing are repeated.

As a result of consideration, the adsorption cryopanel structure according to the present embodiment has a pumping probability P of non-condensable gas expressed by the following expression.

$$P=at(1-t)/(t(1-a)+a)$$

The capturing probability a is a constant representing the performance of the adsorption region. Therefore, the above expression represents the relationship between the pumping probability P and the passage probability t of the adsorption cryopanel 2 of the adsorption cryopanel structure.

Figure 4:
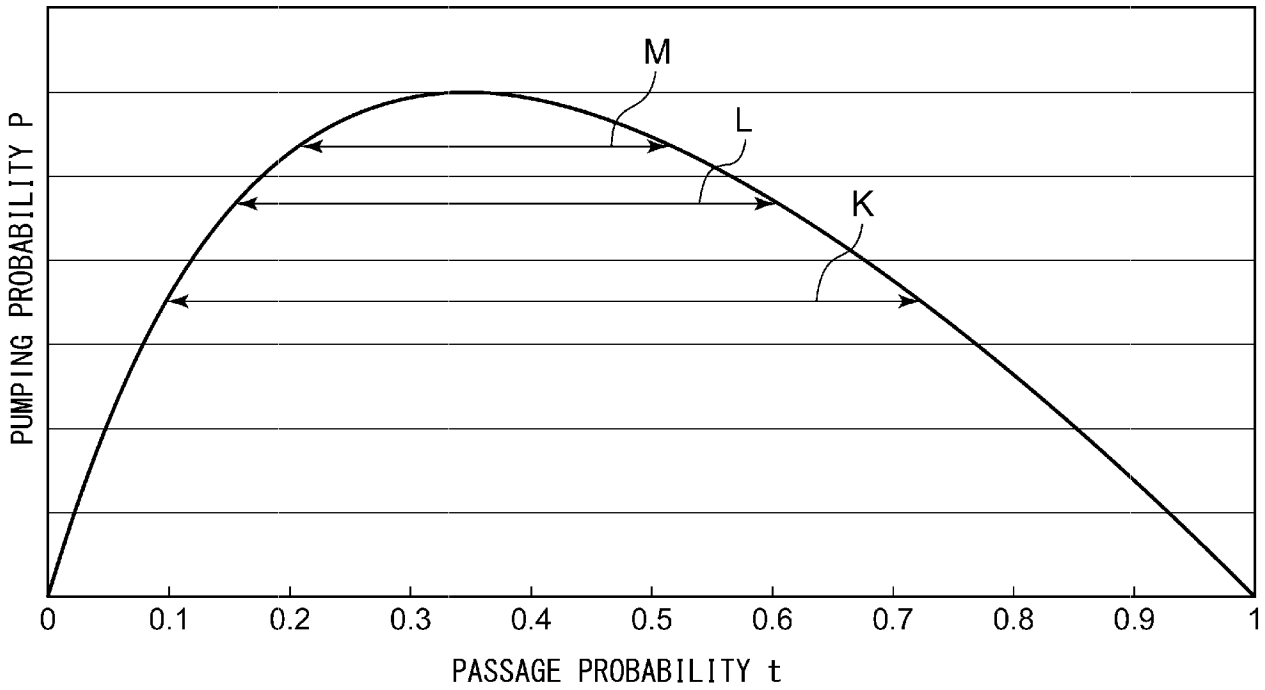
FIG. 4 is a graph illustrating an example of relationship between a pumping probability of an adsorption cryopanel structure and a passage probability of an adsorption cryopanel according to the first embodiment of the present invention.

FIG. 4 is a graph illustrating an example of relationship between the pumping probability P of the adsorption cryopanel structure and the passage probability t of the adsorption cryopanel 2 according to the present embodiment. The vertical axis denotes the pumping probability P, and the horizontal axis denotes the passage probability t. As shown in the drawing, according to the adsorption cryopanel structure according to the present embodiment, the pumping probability P has a mountain-shaped distribution, and the maximum pumping probability P is given at a certain passage probability t. The graph as shown in the drawing represents an analysis result based on the model as shown in FIG. 1. However, even when the adsorption cryopanel structure according to the present embodiment is applied to an actual cryopump, it is clear that the relationship between the pumping probability P and the passage probability t has similar tendency.

Therefore, in order to obtain a preferable pumping probability P, the adsorption cryopanel 2 is preferably configured to have a passage probability of non-condensable gas molecules of 10% or more and 70% or less as shown by the range K of FIG. 4. In order to obtain a more preferable pumping probability P, the adsorption cryopanel 2 is preferably configured to have a passage probability of non-condensable gas molecules of 15% or more and 60% or less as shown by the range L. In order to obtain a still more preferable pumping probability P, the adsorption cryopanel 2 is preferably configured to have a passage probability of non-condensable gas molecules of 20% or more and 50% or less as shown by the range M. In the relationship as shown in FIG. 4, for example, when the adsorption cryopanel 2 has a passage probability of about 35%, the maximum pumping probability is achieved.

In an embodiment, the passage probability of the adsorption cryopanel 2 is embodied by a ratio of the total size of area of the through holes 6 with respect to the size of area of the adsorption cryopanel 2 (which may also be referred to as an opening area ratio). Therefore, the opening area ratio of the adsorption cryopanel 2 is preferably 10% or more and 70% or less, more preferably 15% or more and 60% or less, and still more preferably 20% or more and 50% or less. In other words, the openings occupy 10% or more and 70% or less, 15% or more and 60% or less, or 20% or more and 50% or less of the size of area of the adsorption cryopanel 2.

In order to prevent uneven distribution of the amount of adsorption on the adsorption cryopanel 2, the adsorption cryopanel 2 preferably includes a multitude of through holes 6 distributed uniformly. As described above, when each hole is too large, the reflection by the reflection cryopanel 3 is significant. From such viewpoint, the hole width of the through hole 6 (for example, a hole diameter E as shown in FIG. 2) is preferably about 20 mm or less. In view of ease of processing of the through holes 6 in the cryopanel material (for example, metal), the hole width of the through hole 6 is desirably about 4 mm or more.

In an embodiment, the adsorption region is formed by adhering a granular adsorbent (for example, activated charcoal) to a cryopanel material. In order to accommodate the granular adsorbent in an area of the material portion between two adjacent holes, the hole interval of the through holes 6 (for example, a distance W of two adjacent holes (see FIG. 2)) is desirably about the same as the hole width, for example, 0.5 times to 2 times or 0.8 times to 1.25 times of the hole width.

Even when the adsorption cryopanel 2 and the reflection cryopanel 3 are too close as compared with the hole width of the through hole 6 (for example, a case where a distance H between panels is small as shown in FIG. 1), the non-condensable gas molecules not captured by the adsorption cryopanel structure 8 are increased. This is the same as the case where the through hole 6 is large.

For this reason, the distance between the adsorption cryopanel 2 and the reflection cryopanel 3 is desirably equal to the hole width of the through hole 6 (or the hole interval) or larger than that. More preferably, the distance between the adsorption cryopanel 2 and the reflection cryopanel 3 is equal to twice the hole width of the through hole 6 (or the hole interval) or larger than that. Therefore, in an embodiment, $H/E \geq 1$ holds, and more preferably, $H/E \geq 2$ holds. Alternatively, in an embodiment, $H/W \geq 1$ holds, and more preferably $H/W \geq 2$ holds.

The adsorption cryopanel structure 8 can be applied to any part of the cryopump 1, and contributes to the improvement of the performance of the cryopump 1. Several examples of applications of the adsorption cryopanel structure 8 will be hereinafter explained.

Figure 5:
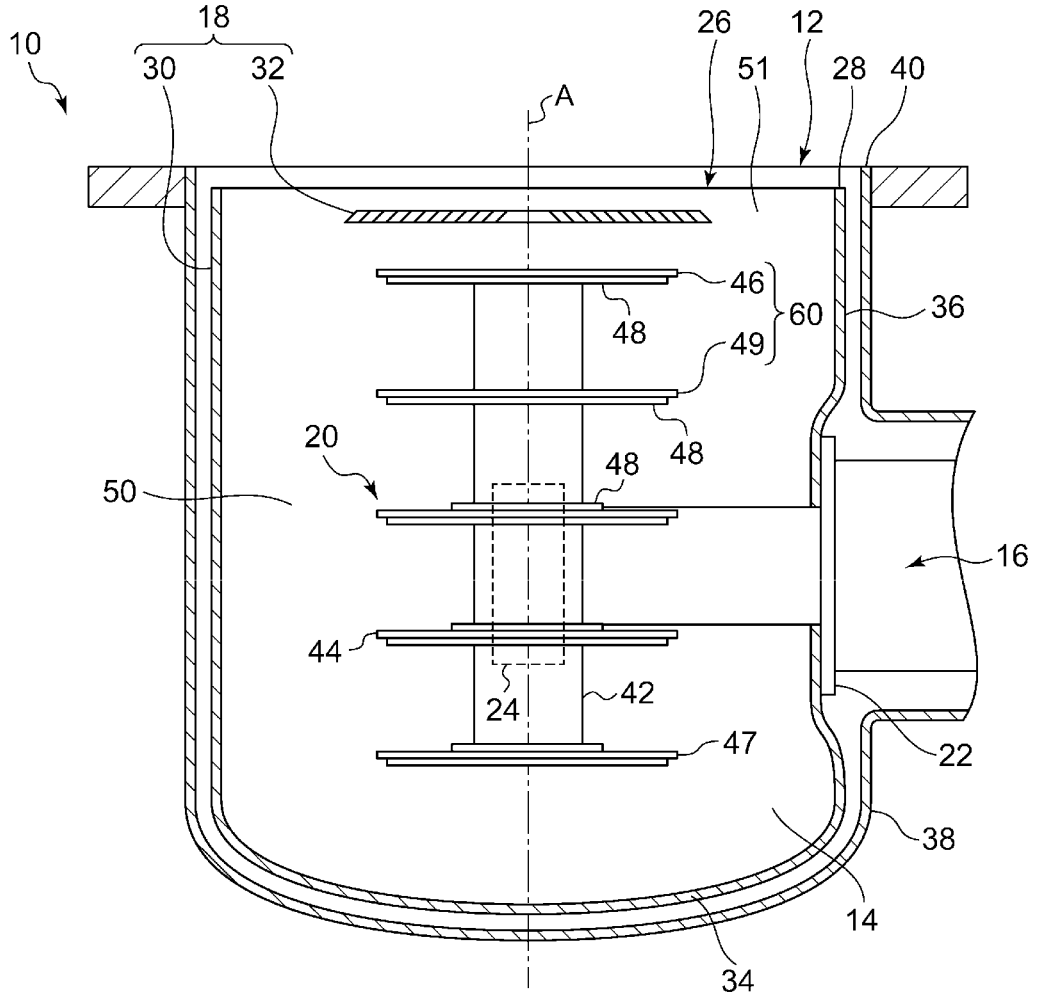
FIG. 5 is a schematic cross-sectional view illustrating relevant components of a cryopump according to a second embodiment of the present invention.

FIG. 5 is a schematic cross-sectional view illustrating relevant components of a cryopump 10 according to a second embodiment of the present invention. The cryopump 10 includes adsorption cryopanel structures 60 each including a top panel 46 and a cryosorption panel 49 adjacent thereto below the top panel 46. More specifically, the top panel 46 corresponds to the adsorption cryopanel 2 according to the first embodiment, and the cryosorption panel 49 corresponds to the reflection cryopanel 3 according to the first embodiment.

Therefore, the top panel 46 includes a front surface configured to receive incidence of non-condensable gas and a back surface including an adsorption region 48 of the non-condensable gas. The front surface of the top panel 46 faces an inlet 12. As the adsorption cryopanel 2 shown in FIG. 2, the top panel 46 is formed with a multitude of holes penetrating from the front surface to the back surface. The cryosorption panel 49 has a reflection surface of the non-condensable gas facing the back surface of the top panel 46. The reflection surface is the front surface of the cryosorption panel 49, and this front surface is not provided with the adsorption region 48.

According to the second embodiment, the non-condensable gas can enter the adsorption cryopanel structure 60 through the through holes of the top panel 46. The entry path of the non-condensable gas molecules is not limited to a gas reception space 50 enclosing the outside of the top panel 46. Therefore, the central portion of the adsorption region 48 of the top panel 46 can also be utilized for pumping of the non-condensable gas.

It should be noted that the location and the orientation where the adsorption cryopanel structure 60 is arranged in the cryopump 10 may be any location and orientation. In an alternative and/or additional embodiment, the cryopump 10 may include an adsorption cryopanel structure 60 including a bottom panel 47 and a cryosorption panel 44 arranged adjacent to and above the bottom panel 47. In this case, the bottom panel 47 corresponds to the adsorption cryopanel 2 according to the first embodiment, and the cryosorption panel 44 corresponds to the reflection cryopanel 3 according to the first embodiment. The front surface of the bottom panel 47 faces a shield bottom portion 34. In an alternative and/or additional embodiment, the cryopump 10 may include an adsorption cryopanel structure 60 including two adjacent cryosorption panels 44 in a cryopanel assembly 20.

Hereinafter, the configuration of the cryopump 10 according to the second embodiment will be explained in detail. The cryopump 10 is mounted on a vacuum chamber of, for example, an ion implantation apparatus or a sputtering apparatus and used to increase the vacuum level inside the vacuum chamber to a level demanded by a desired process. The cryopump 10 includes the inlet 12 to receive gases. Gases to be pumped flow from the vacuum chamber on which the cryopump 10 is mounted, through the inlet 12, into an internal space 14 of the cryopump 10. FIG. 5 is a cross-sectional view including a central axis A of the internal space 14 of the cryopump 10. A dashed-dotted line is used to indicate the central axis A in the figures.

Note that terms "axial direction" and "radial direction" may be used herein to facilitate an understanding of a positional relationship among components of the cryopump 10. The axial direction represents a direction passing the inlet 12 (direction along a dashed-dotted line A in FIG. 5), and the radial direction represents a direction along the inlet 12 (direction perpendicular to the dashed-dotted line A). For convenience, relative closeness to the inlet 12 in the axial direction may be described by terms such as "upper" and "upward," and relative remoteness therefrom therein may be described by terms such as "lower" and "downward." In other words, relative remoteness from the bottom of the cryopump 10 may be described by terms such as "upper" and "upward," and relative closeness thereto may be described by terms such as "lower" and "downward," both in the axial direction. Relative closeness to a center (the central axis A in FIG. 5) of the inlet 12 in the radial direction may be described by terms such as "inner" and "inside," and relative closeness to the circumference of the inlet 12 in the radial direction may be described by terms such as "outer" and "outside." It should be noted here that these terms are not related to a position of the cryopump 10 as mounted on a vacuum chamber. For example, the cryopump 10 may be mounted on a vacuum chamber with the inlet 12 facing downward in the vertical direction.

The cryopump 10 includes a refrigerator 16. The refrigerator 16 is a cryogenic refrigerator, such as a Gifford-McMahon type refrigerator (generally called a GM refrigerator). The refrigerator 16 is a two-stage refrigerator including a first stage 22 and a second stage 24. The refrigerator 16 is configured to cool the first stage 22 to a first temperature level and the second stage 24 to a second temperature level. The second temperature level is lower than the first temperature level. For example, the first stage 22 is cooled to approximately 65 K to 120 K, and preferably to 80 K to 100 K, while the second stage 24 is cooled to approximately 10 K to 20 K.

The cryopump 10 illustrated in FIG. 5 is a so-called horizontal-type cryopump. A horizontal-type cryopump is generally a cryopump arranged such that the refrigerator 16 intersects (orthogonally in general) with the central axis A of the internal space 14 of the cryopump 10. The present invention is also applicable to a vertical-type cryopump in a similar manner. A vertical-type cryopump is a cryopump with a refrigerator arranged along the axial direction of the cryopump.

The cryopump 10 includes a first cryopanel 18 and the cryopanel assembly 20. The first cryopanel 18 is a cryopanel provided to protect the cryopanel assembly 20 from radiant heat emitted from a cryopump housing 38 or outside of the cryopump 10. The first cryopanel 18 includes a radiation shield 30 and an inlet cryopanel 32, and encloses the cryopanel assembly 20. The first cryopanel 18 is thermally connected to the first stage 22. Hence, the first cryopanel 18 is cooled to the first temperature level.

The cryopump housing 38 is a container of the cryopump 10 accommodating the first cryopanel 18 and the cryopanel assembly 20. The inlet 12 is defined by a front end 40 of the cryopump housing 38. The cryopump housing 38 is a vacuum chamber configured to gastightly maintain vacuum of the internal space 14.

The cryopanel assembly 20 is arranged in a center of the internal space 14 of the cryopump 10. The cryopanel assembly 20 includes a plurality of cryopanels and a panel attachment member 42. The cryopanel assembly 20 is attached to the second stage 24 by means of the panel attachment member 42. The cryopanel assembly 20 is thermally connected to the second stage 24 in this way. Therefore, the cryopanel assembly 20 is cooled to a second temperature level.

The adsorption region 48 is formed on at least a portion of the surface of the cryopanel assembly 20. The adsorption region 48 is provided to capture the non-condensable gas (for example, hydrogen) by adsorption. The adsorption region 48 is formed, for example, by adhering the adsorbent (for example, activated charcoal) to the cryopanel surface. A condensation region for capturing condensable gas by condensation is formed on at least a portion of the surface of the cryopanel assembly 20. The condensation region is a section where, for example, the adsorbent is absent on the cryopanel surface, and the cryopanel base material surface such as a metal surface is exposed. Therefore, the condensation region may also be referred to as a non-adsorption region. Therefore, the cryopanel assembly 20 has the cryosorption panel 44 or an adsorption panel having the condensation region (which may also referred to as non-adsorption region) on a part thereof.

The cryosorption panels 44 are arranged along the direction extending from a shield opening 26 to a shield bottom portion 34 (i.e., along the central axis A). The cryosorption panels 44 are each a flat plate (e.g., a disk) that extends perpendicular to the central axis A. The cryosorption panels 44 are mounted to the panel mounting member 42 in parallel with one another. For the sake of explanation, one of the cryosorption panels 44 that is closest to the inlet 12 may be referred to as the top panel 46, and one of the cryosorption panels 44 that is closest to the shield bottom portion 34 may be referred to as the bottom panel 47.

The cryopanel assembly 20 extends elongate along the axial direction between the inlet 12 and the shield bottom portion 34. The distance from the upper end to the lower end of the cryopanel assembly 20 in the axial direction is longer than the external dimension of the cryopanel assembly 20 projected vertically in the axial direction. For example, the distance between the top panel 46 and the bottom panel 47 is larger than the width or diameter of the cryosorption panel 44.

The cryosorption panels 44 are flat plates (for example, circular plates) each extending perpendicular to the central axis A, and the adsorption regions 48 are formed on both surfaces thereof. The adsorption region 48 is formed at a position which is shadowed by the cryosorption panel 44 adjacent to the upper side thereof so that it is not seen from the inlet 12. More specifically, the adsorption region 48 is formed in the central portion of the upper surface of each cryosorption panel 44 and the entire lower surface thereof. However, the adsorption region 48 is not provided on the upper surface of the top panel 46 and the upper surface of the cryosorption panel 49 immediately below the top panel 46 adjacent thereto.

Each of the cryosorption panels 44 may have the same shape as shown in the drawing, and may have different shapes (for example, different diameters). A cryosorption panel 44 among the plurality of cryosorption panels 44 may have the same shape as that of a cryosorption panel 44 that is adjacent in the upper direction or may be larger than the adjacent cryosorption panel 44. As a result, the bottom panel 47 may be larger than the top panel 46. The size of area of the bottom panel 47 may be about 1.5 times to about 5 times of the size of area of the top panel 46.

The interval between the cryosorption panels 44 may be constant as shown in the drawing, or may be different from each other.

The cryopump suggested previously by the applicant of the present application also includes a cryopanel assembly, or arrangement of multiple cryosorption panels, suitable for pumping of the non-condensable gas. Such cryopump is disclosed in, for example, Japanese Patent Application Laid-Open No. 2012-237262, and United States Patent Application Publication No. 2013/0008189, which are incorporated herein in their entirety by reference.

The radiation shield 30 is provided to protect the cryopanel assembly 20 from radiant heat emitted from the cryopump housing 38. The radiation shield 30 is located between the cryopump housing 38 and the cryopanel assembly 20, and encloses the cryopanel assembly 20. The radiation shield 30 includes a shield front end 28 defining the shield opening 26, the shield bottom portion 34 facing the shield opening 26, and a shield side portion 36 extending from the shield front end 28 to the shield bottom portion 34. The shield opening 26 is located at the inlet 12. The radiation shield 30 has a tubular shape (for example, cylindrical) with the shield bottom portion 34 closed to be formed into a cup-like shape.

The shield side portion 36 has a hole for attaching the refrigerator 16, and the second stage 24 of the refrigerator 16 is inserted into the radiation shield 30 through the hole. The first stage 22 is fixed to an outer surface of the radiation shield 30 at the periphery of the attaching hole. The radiation shield 30 is thermally connected to the first stage 22 in this way.

The radiation shield 30 may not be formed as a one-piece tube as illustrated in the drawing. Alternatively, a plurality of parts may form a tubular shape as a whole. The plurality of parts may be arranged so as to have a gap between one another. For example, the radiation shield 30 is divided into two portions in the axial direction. In this case, the upper portion of the radiation shield 30 is a tube both sides of which are open, and the lower portion of the radiation shield 30 is configured such that the upper end is open and the lower end has the shield bottom portion 34.

The radiation shield 30 forms the gas reception space 50, enclosing the cryopanel assembly 20, between the inlet 12 and the shield bottom portion 34. The gas reception space 50 is a part of the internal space 14 of the cryopump 10, and is a region adjacent to the cryopanel assembly 20 in the radial direction. The gas reception space 50 encloses the external periphery of each cryosorption panel 44 over the range extending from the inlet 12 to the shield bottom portion 34 in the axial direction.

The inlet cryopanel 32 is also provided at the inlet 12 (or the shield opening 26, which is also applicable to the following description) to protect the cryopanel assembly 20 from radiant heat emitted from a heat source outside the cryopump 10 (for example, a heat source inside a vacuum chamber on which the cryopump 10 is mounted). Gases (for example, moisture) that condense at the cooling temperatures of the inlet cryopanel 32 are trapped on a surface thereof.

The inlet cryopanel 32 is arranged at the inlet 12 at a location corresponding to the cryopanel assembly 20. The inlet cryopanel 32 occupies the central portion of the opening area of the inlet 12, and forms an annular open region 51 between the inlet cryopanel 32 and the radiation shield 30. The open region 51 is at a location corresponding to the gas reception space 50 at the inlet 12. The gas reception space 50 is located at the external peripheral portion of the internal space 14 so as to enclose the cryopanel assembly 20, and therefore, the open region 51 is at the external peripheral portion of the inlet 12. The open region 51 is an entrance of the gas reception space 50, and the cryopump 10 receives the gas via the open region 51 into the gas reception space 50.

The inlet cryopanel 32 is attached to the shield front end 28 by means of an attachment member (not shown). The inlet cryopanel 32 is fixed to the radiation shield 30, and is thermally connected to the radiation shield 30. The inlet cryopanel 32 is close to the cryopanel assembly 20 but is not in contact therewith.

The inlet cryopanel 32 has a flat structure provided at the inlet 12. The inlet cryopanel 32 may have, for example, flat (for example, circular) plate, or may have louvers or chevrons formed in a concentric or lattice-like manner. The inlet cryopanel 32 may be arranged to extend across the entire inlet 12. In such case, the open region 51 may be formed by eliminating a part of the plate or removing some of the blades of the louvers or chevrons.

Figure 6:
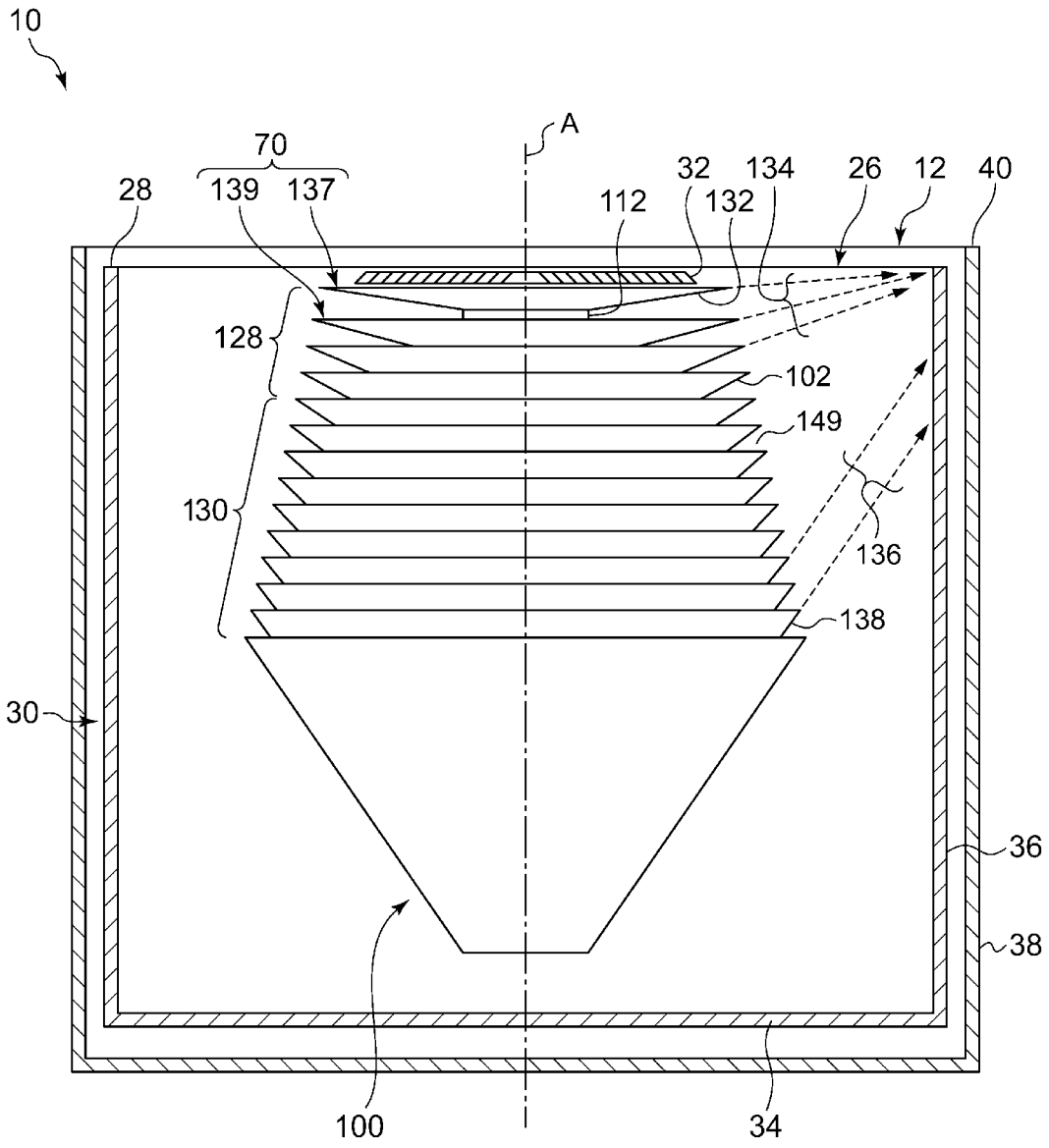
FIG. 6 is a schematic cross-sectional view illustrating relevant components of a cryopump according to a third embodiment of the present invention.

FIG. 6 is a schematic cross-sectional view illustrating relevant components of the cryopump 10 according to the third embodiment of the present invention. The cryopump 10 according to the third embodiment has a cryopanel assembly 100 including a plurality of cryopanels 102 arranged in a nested manner, instead of the cryopanel assembly 20 according to the second embodiment. For the sake of brevity, in FIG. 6, the refrigerator 16 is omitted.

The cryopanels 102 are arranged densely in an overlapping manner in the axial direction. However, as shown in FIG. 6, a top panel 137, i.e., one of the cryopanels 102 that is closest to the inlet cryopanel 32 does not overlap with, in the axial direction, a cryopanel 139 which is the second closest to the inlet cryopanel 32.

The cryopanel assembly 100 has an adsorption cryopanel structure 70 including the top panel 137 and the cryopanel 139 adjacent thereto below the top panel 137. More specifically, the top panel 137 corresponds to the adsorption cryopanel 2 according to the first embodiment, and the cryopanel 139 corresponds to the reflection cryopanel 3 according to the first embodiment.

Therefore, the top panel 137 includes a front surface configured to receive incidence of non-condensable gas and a back surface including the adsorption region of the non-condensable gas. The front surface of the top panel 137 faces the inlet 12. As the adsorption cryopanel 2 shown in FIG. 2, the top panel 137 is formed with a multitude of holes penetrating from the front surface to the back surface. The cryopanel 139 has a reflection surface of the non-condensable gas facing the back surface of the top panel 137. The reflection surface is the front surface of the cryopanel 139, and this front surface is not provided with the adsorption region.

Figure 7:
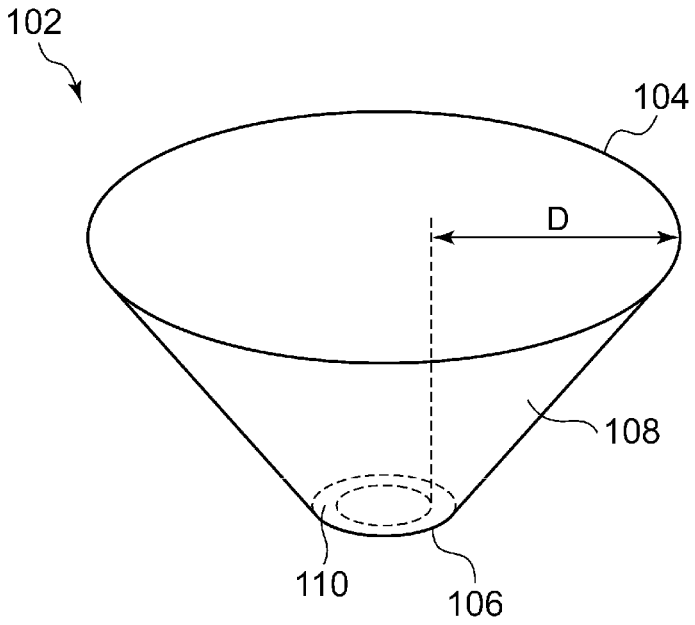
FIG. 7 is a perspective view schematically illustrating a cryopanel according to the third embodiment of the present invention.

FIG. 7 is a perspective view schematically illustrating the cryopanel 102 according to the third embodiment of the present invention. The cryopanel 102 has a shape in an inverted truncated cone. The cryopanel 102 may have a shape of a cone-shaped, a deep-dish, or a ball-shaped form. The cryopanel 102 is configured such that an upper end portion 104 has a large size (i.e., large diameter), and a lower end portion 106 is of a smaller dimension than that (i.e., small diameter).

The cryopanel 102 includes an inclination region 108 connecting the upper end portion 104 and the lower end portion 106. The inclination region 108 corresponds to the side surface of the inverted truncated cone. Therefore, the cryopanel 102 is inclined so that the normal line of the front surface of the cryopanel 102 crosses the central axis A. The inclination region 108 substantially occupies all of the width D of the cryopanel in the radial direction.

However, as shown in FIG. 7, the cryopanel 102 has an attachment portion 110 at the lower end portion 106. The attachment portion 110 is a flat region. The attachment portion 110 is a flange for attaching the cryopanel 102 to the panel attachment member 112 (see FIG. 2). The panel attachment member 112 is provided to mechanically fix the cryopanel 102 to the second stage 24 of the refrigerator 16 (see FIG. 5) and thermally connects the cryopanel 102 to the second stage 24 of the refrigerator 16 (see FIG. 5). When such flat attachment flange is provided, it is easy to attach the cryopanel 102 to the panel attachment member 112.

The cryopanel 102 may be formed with a cut-out or opening (not shown) through which the refrigerator 16 is inserted.

As shown in FIG. 6, a plurality of cryopanels 102 are provided coaxially with the central axis A of the radiation shield 30. Therefore, each inclination region 108 of the cryopanels 102 is inclined so that it is away from the shield opening 26 at the lower end portion 106 which is close to the central axis A (see FIG. 7), and that it is close to the shield opening 26 at the upper end portion 104 which is away from the central axis A. A cryopanel 102 which is close to the inlet 12 is smaller than another cryopanel 102 which is away from the inlet 12. An upper one of two cryopanels 102 adjacent to each other has a diameter smaller than that of a lower one of the two cryopanels 102.

The cryopanel assembly 100 is divided into an upper structure 128 and a lower structure 130. The upper structure 128 includes at least one cryopanel 102, and the at least one cryopanel 102 has an inclination region 108 (see FIG. 7) having an inclination angle toward the shield front end 28. The cryopanel 102 having such inclination may be hereinafter referred to as an upper cryopanel. The inclination angle of the cryopanel is an angle between the surface of the cryopanel 102 and the plane perpendicular to the central axis A.

The upper cryopanel 102 has an inclination angle adjusted so that a back surface 132 cannot be seen from the outside of the cryopump 10. More specifically, the inclination angle of the back surface 132 (more specifically, the inclination region 108) is determined so that the line of sight from the shield front end 28 does not cross the back surface 132. Therefore, the external side end of the upper cryopanel 102 is directed to a point slightly below the shield front end 28 as indicated by arrow 134 of the broken line in FIG. 6. Therefore, each of the upper cryopanels 102 has a different inclination angle, and the cryopanels at the upper side have smaller inclination angles. In order to make the back surface 132 of the upper cryopanel 102 to be invisible from the outside of the cryopump 10, it may be necessary to consider the line of sight from the front end 40 of the cryopump housing 38, instead of the shield front end 28.

The lower structure 130 of the cryopanel assembly 100 includes at least one cryopanel 102. As indicated by arrow 136 of broken line in FIG. 6, the at least one cryopanel 102 includes an inclination region 108 (see FIG. 7) inclined toward the shield side portion 36. The cryopanel 102 having such inclination may be hereinafter referred to as a lower cryopanel. More specifically, the lower cryopanel 102 has an inclination angle toward the shield side portion 36, and therefore, a back surface 138 cannot be seen from the outside of the cryopump 10. Each of the lower cryopanels 102 has the same inclination angle.

In an embodiment, at least some or all of the cryopanels 102 of the upper structure 128 may be arranged in parallel as the cryopanel 102 of the lower structure 130. When all are in parallel, the manufacturing process is easy. In this case, the end of the top panel 137 may be directed toward the cryopump front end (or slightly lower side of the cryopump front end), and the cryopanels below the top panel 137 may be directed toward the shield side portion 36.

As compared with the inner peripheral end of a certain upper cryopanel, external peripheral ends of several cryopanels below it are closer to the inlet 12. In other words, the inclination portion of a certain lower cryopanel extends beyond the inner peripheral ends of several cryopanels above it and extends to the diagonally upper side. In this manner, an elongate gap 149 is formed to receive hydrogen gas between the upper-side cryopanel and the lower-side cryopanel, and hence the cryopanels 102 are arranged in a nested manner.

The positional relationship of the cryopanels described above is applicable to not only the lower structure 130 but also some of the cryopanels of the upper structure 128. However, this positional relationship is significant in the lower structure 130. For example, the external peripheral end of the lowermost cryopanel is closer to the inlet 12 than the inner peripheral end of the cryopanel that is six cryopanels above the lowermost cryopanel.

The gap 149 extends deeply along the inclination region 108. The depth of the gap is larger than the width of the gap entrance. The cryopanel assembly 100 has such deep gap structure, and therefore, the capturing rate of the hydrogen gas can be improved. More specifically, the hydrogen molecules that have once entered the gap 149 can be captured without losing them as much as possible.

The adsorption region is formed on the entire region of the back surface 132 of the upper cryopanel 102. The adsorption region is formed on the entire region of the back surface 138 of the lower cryopanel 102. On the front surface of a given cryopanel, the adsorption region is formed at the inner side of a border, which is the line of sight drawn from the shield front end 28 to the external peripheral end of another cryopanel immediately above the given cryopanel. The entire region of the front surface of the uppermost cryopanel closest to the inlet 12, i.e., top panel 137, is a condensation region. The entire region of the front surface of several cryopanels closest to the inlet 12 may be condensation region.

In this manner, each of the plurality of cryopanels 102 has an adsorption region in a portion which cannot be seen from the outside of the cryopump 10. Therefore, the cryopanel assembly 100 is configured such that the adsorption region is completely invisible from the outside of the cryopump 10.

By the way, usually, the gas accumulated in the cryopump is substantially completely discharged by the regeneration process, and when the regeneration is completed, the cryopump recovers the pumping performance according to the specification. However, some of the gases accumulated may remain in the adsorbent with a relatively high degree of possibility even after the regeneration process.

For example, in a cryopump installed for evacuation of an ion implantation apparatus, it is observed that a sticky substance attaches to the activated charcoal serving as the adsorbent. It is difficult to completely remove this sticky substance even after the regeneration process. This sticky substance is considered to be caused by organic outgas discharged from a photoresist covering a substrate to be processed. Alternatively, the sticky substance may be caused by poisonous gas used as source gas, i.e., dopant gas in the ion implantation process. Alternatively, the sticky substance may be caused by other by-product gases in the ion implantation process. The sticky substance may be generated due to these gases in a complex manner.

In the ion implantation process, most of the gases pumped by the cryopump may be hydrogen gas. The hydrogen gas is substantially completely discharged to the outside by regeneration. When the quantity of the gas that is difficult to be removed by regeneration, which may be referred to as a hard-to-regenerate gas, is very small, the hard-to-regenerate gas does not greatly affect the pumping performance of the cryopump in one cryopumping process. When the cryopumping process and regeneration process are repeated, the hard-to-regenerate gas is gradually accumulated in the adsorbent, which may reduce the pumping performance. When the pumping performance is less than the allowable range, for example, maintenance work is required, which includes replacing the adsorbent or the adsorbent and the cryopanels, or a chemical treatment performed on the adsorbent for removing the hard-to-regenerate gas.

The hard-to-regenerate gas is condensable gas without exception. The molecules of the condensable gas flying from the outside to the cryopump 10 pass through the open region around the inlet cryopanel 32, and reach the condensation region on the external periphery of the cryopanel assembly 100 or the radiation shield 30 through a linear path, and the molecules are captured by the surfaces thereof. By avoiding exposure of the adsorption region to the inlet 12, the adsorption region is protected from the hard-to-regenerate gas which is included in the gases entering the cryopump 10. The hard-to-regenerate gas is accumulated in the condensation region. Therefore, it is possible to achieve not only high speed pumping of the non-condensable gas but also protection of the adsorption region from the hard-to-regenerate gas. Avoiding exposure of the adsorption region is also useful for protecting the adsorption region from moisture.

The cryopump 10 can receive the hydrogen molecules, which have entered, by the elongate gap 149 between cryopanels 102. The hydrogen molecules incident upon the gap 149 are guided to the deeper portion of the gap 149 by the reflection on the cryopanel surface. The adsorption region is formed in the central region of the cryopanel structure. Therefore, the hydrogen molecules can be effectively adsorbed, and the high speed pumping of the hydrogen gas can be achieved.

A cryopump that has been suggested by the applicant of the present application also has a unique cryopanel structure that achieves not only high speed pumping of the hydrogen but also protection of the adsorbent. In this cryopanel structure, each cryopanel extends toward the radiation shield along the plane perpendicular to the central axis of the cryopump. Such cryopanel structure is shown in FIG. 5, for example. It has been confirmed by means of simulation based on Monte Carlo method that, as compared with a cryopump having such horizontal cryopanels, the cryopump having inclination cryopanels according to the present embodiment has 20% to 30% higher pumping speed of the hydrogen gas.

Figure 8:
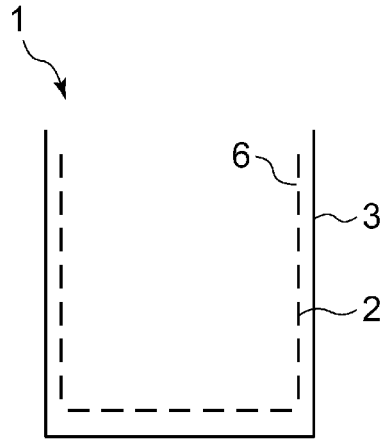
FIG. 8 is a schematic cross-sectional view illustrating relevant components of a cryopump according to a fourth embodiment of the present invention.

FIG. 8 is a schematic cross-sectional view illustrating relevant components of a cryopump 1 according to a fourth embodiment of the present invention. In the cryopump 1 according to the fourth embodiment, the reflection cryopanel 3 is at least part of the radiation shield, and the adsorption cryopanel 2 is arranged adjacent to the at least part of the radiation shield. The adsorption cryopanel 2 is a tube-like member including a multitude of through holes 6. This tube-like member is slightly smaller than the reflection cryopanel 3. The adsorption cryopanel 2 covers substantially all of the inner surfaces of the reflection cryopanel 3. In this manner, the adsorption cryopanel structure may be formed on the immediately inner side of both of the side surface and the bottom surface of the radiation shield. The cryopump 1 according to the fourth embodiment may also have the cryopanel assembly 20 according to the second embodiment or the cryopanel assembly 100 according to the third embodiment.

Figure 9:
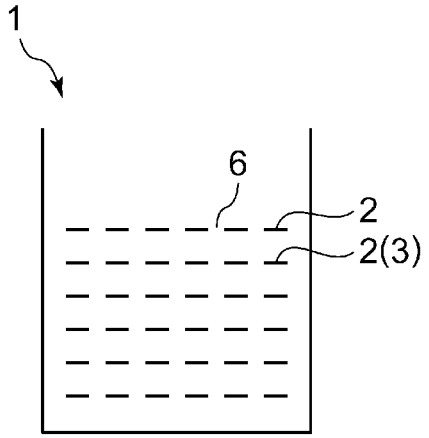
FIG. 9 is a schematic cross-sectional view illustrating relevant components of a cryopump according to a fifth embodiment of the present invention.

FIG. 9 is a schematic cross-sectional view illustrating relevant components of a cryopump 1 according to a fifth embodiment of the present invention. The cryopump 1 according to the fifth embodiment includes a plurality of adsorption cryopanels 2. The plurality of adsorption cryopanels 2 are arranged in parallel to each other in the axial direction, and are enclosed by the radiation shield 30. The reflection cryopanel 3 in the cryopump 1 is an adsorption cryopanel 2 adjacently below any given adsorption cryopanel 2. Each adsorption cryopanel 2 includes a multitude of through holes 6. In this case, each adsorption cryopanel 2 may be formed so that the upper adsorption cryopanels 2 have higher passage probability.

The above has described the present invention based on an embodiment. Those skilled in the art will appreciate that the present invention is not limited to the embodiment described above, that various design changes and modifications are possible, and that such modifications are within the scope of the present invention.

For example, the shape of the opening (for example, a hole and a slit) formed in the adsorption cryopanel 2 may be any shape. In the above embodiments, the opening is in a shape having a closed profile, but is not limited thereto. The adsorption cryopanel 2 may have an opening having a profile which is open to the external periphery of the cryopanel. When the arrangement of the openings is in a regular pattern or lattice-like form as described above, this is advantageous in terms of manufacturing process, but the arrangement may be any other arrangement.

The adsorption cryopanel 2 and/or the reflection cryopanel 3 may be made of a plurality of pieces. For example, the adsorption cryopanel 2 may have a frame structure or a skeleton structure including a plurality of elongate members.

It should be understood that the invention is not limited to the above-described embodiment, but may be modified into various forms on the basis of the spirit of the invention. Additionally, the modifications are included in the scope of the invention.

Priority is claimed to Japanese Patent Application No. 2013-111346, filed on May 27, 2013, the entire content of which is incorporated herein by reference.

What is claimed is:

1. A cryopump comprising: a radiation shield defining a shield opening and comprising a shield bottom opposite to the shield opening in an axial direction of the radiation shield; and an array of cryopanels arranged within the radiation shield, the array of cryopanels comprising a plurality of cryopanels arranged in the axial direction of the radiation shield, the plurality of cryopanels including an adsorption top cryopanel arranged closest to the shield opening in the plurality of cryopanels and comprising a front surface oriented to the shield opening and configured to receive incidence of a non-condensable gas and a back surface oriented to the shield bottom and comprising an adsorption region of the non-condensable gas; a reflection lower cryopanel arranged second closest to the shield opening in the plurality of cryopanels and between the adsorption top cryopanel and the shield bottom and comprising a reflection surface of the non-condensable gas facing the back surface of the adsorption top cryopanel; and a third cryopanel, wherein the adsorption top cryopanel has a multitude of holes penetrating from the front surface to the back surface, wherein the adsorption top cryopanel does not overlap with the reflection lower cryopanel in the axial direction of the radiation shield, at least the third cryopanel overlaps the reflection lower cryopanel in the axial direction of the radiation shield.

2. The cryopump according to claim 1 comprising:

a refrigerator configured to cool the radiation shield to a first cooling temperature, and configured to cool the array of cryopanels to a second cooling temperature lower than the first cooling temperature.

3. The cryopump according to claim 1, wherein the adsorption top cryopanel has a passage probability of the non-condensable gas selected from a range of 10% to 70%.

4. The cryopump according to claim 1, wherein a distance between the adsorption top cryopanel and the reflection lower cryopanel is equal to or larger than a hole width of the multitude of holes.

5. The cryopump according to claim 1, wherein a hole width of the multitude of holes is 4 mm or more and 20 mm or less.

6. The cryopump according to claim 1, wherein the reflection cryopanel is at least part of the radiation shield, and the adsorption top cryopanel is adjacent to the at least part of the radiation shield.

7. The cryopump according to claim 1, wherein the reflection lower cryopanel is disposed adjacent to the adsorption top cryopanel, and comprises a second adsorption region of the non-condensable gas and a second multitude of holes penetrating the reflection lower cryopanel.

8. A vacuum pumping method for using the cryopump according to claim 1, the method comprising: receiving the non-condensable gas through the adsorption top cryopanel into a space between the adsorption top cryopanel and the relection lower cryopanel adjacent to the adsorption top cryopanel, the adsorption top cryopanel having a passage probability of the non-condensable gas selected from a range of 10% to 70%; reflecting the non-condensable gas using the reflection lower cryopanel adjacent to the adsorption top cryopanel; and adsorbing the reflected non-condensable gas on the adsorption top cryopanel.

9. The cryopump according to claim 1, wherein the adsorption top cryopanel is shaped as an inverted truncated cone.

10. The cryopump according to claim 1, wherein the adsorption top cryopanel comprises a larger upper end and a smaller lower end.

11. The cryopump according to claim 1, wherein the reflection lower cryopanel is larger than the adsorption top cryopanel.

12. The cryopump according to claim 1, wherein the reflection lower cryopanel is upwardly inclined to a front end or side of the radiation shield and has a larger inclination angle compared to the adsorption top cryopanel.

13. The cryopump according to claim 1, wherein the reflection lower cryopanel is located immediately below the adsorption top cryopanel in the axial direction of the radiation shield.

14. The cryopump according to claim 1, wherein the reflection surface is comprised of a different material than the adsorption region.

15. A cryopump comprising: a radiation shield defining a shield opening and axially extending from the shield opening; an adsorption top cryopanel comprising a front surface oriented to the shield opening and configured to receive incidence of a non-condensable gas and a back surface comprising an adsorption region of the non-condensable gas; and a reflection lower cryopanel comprising a reflection surface of the non-condensable gas facing the back surface, the reflection lower cryopanel located immediately below the adsorption top cryopanel in an axial direction of the radiation shield; and a third cryopanel, wherein the adsorption top cryopanel has a multitude of holes penetrating from the front surface to the back surface, wherein the adsorption top cryopanel does not overlap with the reflection lower cryopanel in the axial direction of the radiation shield, the third cryopanel overlaps the reflection lower cryopanel in the axial direction of the radiation shield.

16. A vacuum pumping method for pumping a non-condensable gas using the cryopump according to claim 15, the method comprising: receiving the non-condensable gas through the adsorption top cryopanel into a space between the adsorption top cryopanel and the reflection lower cryopanel adjacent to the adsorption top cryopanel, the adsorption top cryopanel having a passage probability of the non-condensable gas selected from a range of 10% to 70%; reflecting the non-condensable gas using the reflection lower cryopanel adjacent to the adsorption top cryopanel; and adsorbing the reflected non-condensable gas on the adsorption top cryopanel.

17. The cryopump according to claim 15, wherein the adsorption top cryopanel has a passage probability of the non-condensable gas selected from a range of 10% to 70%.

18. The cryopump according to claim 15, wherein the adsorption top cryopanel is shaped as an inverted truncated cone.

19. The cryopump according to claim 15, wherein the adsorption top cryopanel comprises a larger upper end and a smaller lower end.

20. The cryopump according to claim 15, wherein the reflection lower cryopanel is larger than the adsorption top cryopanel.

21. A cryopump comprising: a radiation shield defining a shield opening and comprising a shield bottom opposite to the shield opening in an axial direction of the radiation shield; and an array of cryopanels arranged within the radiation shield, the array of cryopanels comprising a plurality of cryopanels arranged in the axial direction of the radiation shield, the plurality of cryopanels including an adsorption top cryopanel arranged closest to the shield opening in the plurality of cryopanels and comprising a front surface oriented to the shield opening and configured to receive incidence of a non-condensable gas and a back surface oriented to the shield bottom and comprising an adsorption region of the non-condensable gas; and a reflection lower cryopanel arranged second closest to the shield opening in the plurality of cryopanels and between the adsorption top cryopanel and the shield bottom and comprising a reflection surface of the non-condensable gas facing the back surface of the adsorption top cryopanel, wherein the adsorption top cryopanel has a multitude of holes penetrating from the front surface to the back surface, wherein the adsorption top cryopanel does not overlap with the reflection lower cryopanel in the axial direction of the radiation shield, wherein the array of cryopanels includes further cryopanels arranged between the reflection lower cryopanel and the shield bottom in an overlapping manner in the axial direction of the radiation shield.

* * * * *